US007008917B2

(12) United States Patent
Heise et al.

(10) Patent No.: US 7,008,917 B2
(45) Date of Patent: Mar. 7, 2006

(54) CLEANING COMPOSITION IN A CONCENTRATED FORM COMPRISING TETRAHYDROFURFURYL ALCOHOL

(75) Inventors: Karl A. Heise, Charleston, SC (US); Jerry Moore, Fairfax, VA (US)

(73) Assignee: The Knockout Group, Inc., Chicago, IL (US)

( * ) Notice: Subject to any disclaimer, the term of this patent is extended or adjusted under 35 U.S.C. 154(b) by 69 days.

(21) Appl. No.: 10/868,541

(22) Filed: Jun. 15, 2004

(65) Prior Publication Data

US 2005/0277572 A1 Dec. 15, 2005

(51) Int. Cl.
*C11D 1/825* (2006.01)
*C11D 3/32* (2006.01)
*C11D 3/43* (2006.01)

(52) U.S. Cl. ..... 510/501; 510/153; 510/253; 510/289; 510/356; 510/432; 510/413; 510/421; 510/480; 510/524; 510/525

(58) Field of Classification Search ..... 510/153, 510/253, 289, 356, 432, 413, 421, 480, 501, 510/525, 524
See application file for complete search history.

(56) References Cited

U.S. PATENT DOCUMENTS

| | | | | | |
|---|---|---|---|---|---|
| 3,912,808 | A | * | 10/1975 | Sokol | 424/70.2 |
| 3,957,970 | A | * | 5/1976 | Korkis | 424/70.12 |
| 3,970,595 | A | * | 7/1976 | Ginn et al. | 510/535 |
| 4,514,325 | A | * | 4/1985 | Russo et al. | 148/253 |
| 4,678,606 | A | * | 7/1987 | Akhter et al. | 510/159 |
| 4,948,531 | A | * | 8/1990 | Fuggini et al. | 510/400 |
| 4,954,286 | A | * | 9/1990 | Sepulveda et al. | 510/284 |
| 5,259,993 | A | * | 11/1993 | Short | 510/203 |
| 5,454,984 | A | * | 10/1995 | Graubart et al. | 510/384 |
| 5,540,853 | A | * | 7/1996 | Trinh et al. | 510/101 |
| 5,565,146 | A | * | 10/1996 | Jakubicki et al. | 510/235 |
| 5,759,980 | A | | 6/1998 | Russo et al. | |
| 6,720,297 | B1 | | 4/2004 | Jenevein | |
| 6,732,747 | B1 | | 5/2004 | Wise | |
| 2004/0043041 | A1 | | 3/2004 | Baker, Jr. et al. | |

* cited by examiner

*Primary Examiner*—Charles Boyer
(74) *Attorney, Agent, or Firm*—MacCord Mason PLLC

(57) ABSTRACT

A cleaning composition, in a concentrated form comprising a water-soluble organic solvent, an ionic surfactant, a non-ionic surfactant, a chelating agent, and distilled water.

50 Claims, No Drawings

CLEANING COMPOSITION IN A CONCENTRATED FORM COMPRISING TETRAHYDROFURFURYL ALCOHOL

CROSS-REFERENCE TO RELATED APPLICATIONS

This nonprovisional utility patent application is copending with nonprovisional application Ser. No. 10/868,649 filed on Jun. 15, 2004, and nonprovisional application Ser. No. 10/868,484 filed on Jun. 15, 2004.

BACKGROUND OF THE INVENTION (1) Field of the Invention

The present invention relates generally to a cleaning composition and, more particularly, to an all-purpose cleaning composition in a concentrated form for use in cleaning textiles, glass, automobiles, and hard surfaces.

(2) Description of the Prior Art

There are a large number of cleaning products currently on the market. Typically, cleaning compositions, detergents, and the like contain a combination of many components including but not limited to anionic surfactants, cationic surfactants, nonionic surfactants, builders, suds-stabilizers, buffers, disinfecting agents, wetting agents, and chelating agents. Often these cleaning compositions employ components that may have adverse effects on the environment such as phosphorous compounds, peroxygen compounds, chlorine bleach compounds, and fluorinated compounds.

Prior art related to this invention is as follows:

U.S. Pat. No. 6,720,297 issued to Jenevein on Apr. 13, 2004 for a cleaning composition teaches a cleaning composition for treating and removing stains from a non-porous surface has one or more salts, such as quaternary ammonium salts, sulfates and chlorides, a chelator and a dispersant, dissolved in an aqueous solution of alcohol. The preferred salts are myristyltrimethylammonium bromide and benzethonium chloride, the chelator is tetrasodium salt ethylenediamine of tetraacetic acid, and the dispersant is polyvinyl alcohol. The cleaning composition is incorporated into a product, which has a non-woven polyester carrier impregnated with the cleaning composition.

U.S. Pat. No. 5,759,980 issued to Russo, et al. on Jun. 2, 1998 for a car wash teaches a novel car wash composition substantially eliminates water-spotting. This novel car wash composition is comprised of: a surfactant package which is comprised of a first surfactant selected from the group consisting essentially of an anionic surfactant, a nonionic surfactant and mixtures thereof; and a second surfactant selected from the group consisting essentially of fluorosurfactant, a silicone surfactant, and mixtures thereof; and a substantive polymer that renders the surface to be cleaned more hydrophilic.

U.S. Pat. No. 6,732,747 issued to Wise on May 11, 2004 for a composition and method for cleaning and disinfecting a garbage disposal teaches an improved composition and method for cleaning and disinfecting a garbage disposal that does not require aerosol propellants or carbon dioxide gas generating reaction systems. The composition comprises a suds stabilizing surfactant and a disinfecting agent, plus other optional ingredients such as additional detergent surfactant and scouring agents. The required disinfecting agent is selected from the group consisting of quaternary ammonium compounds, halogenated compounds, phenolics, alcohols, aldehydes, oxidizing agents and mixtures thereof.

U.S. Patent Application Pub. No. 20040043041 to Baker, James R. JR., et al. on Mar. 4, 2004 for antimicrobial compositions and methods of use teaches compositions and methods for decreasing the infectivity, morbidity, and rate of mortality associated with a variety of pathogenic organisms and viruses. The reference invention also relates to methods and compositions for decontaminating areas colonized or otherwise infected by pathogenic organisms and viruses. Moreover, the reference invention relates to methods and compositions for decreasing the infectivity of pathogenic organisms in foodstuffs. In particular, decreased pathogenic organism infectivity, morbidity, and mortality are accomplished by contacting the pathogenic organism with an oil-in-water nanoemulsion comprising an oil, an organic solvent, and a surfactant dispersed in an aqueous phase. In some preferred embodiments, the solvent comprises an organic phosphate solvent. In still other embodiments, the organic phosphate-based solvent comprises dialkyl phosphates or trialkyl phosphates (e.g., tributyl phosphate).

While these compositions can lead to a useful cleaning agent, a simpler composition that retains superior cleaning activity while reducing the number of components could simplify the manufacturing process potentially reducing production costs without sacrificing product quality. Further, many of these cleaning compositions employ components that may have adverse effects on the environment. Thus, there remains a need for a superior cleaning composition having a simple composition that is environmentally friendly, easily formulated, and cost effective.

SUMMARY OF THE INVENTION

The present invention is directed to a cleaning composition in a concentrated form for use in cleaning a range of materials including but not limited to textiles, glass, automobiles, and hard surfaces. Thus, the present invention provides a cleaning composition in a concentrated form comprising a water-soluble organic solvent, at least one ionic surfactant, at least one nonionic surfactant, a chelating agent, and distilled water; thereby providing a superior cleaning composition having a simple composition that is easily formulated, and cost effective.

Testing has shown that the present invention causes low to no eye irritability and low to no toxicity in marine environments. The composition received a zero rating as an eye irritant, and an aquatic mortality rating of zero. Thus the cleaning composition of the present invention is environmentally friendly.

DETAILED DESCRIPTION OF THE PREFERRED EMBODIMENTS

The present invention provides an all-purpose cleaning composition in a concentrated form, or cleaning concentrate, with superior cleaning ability for a range of materials including but not limited to textiles, glass, automobiles, and hard surfaces. The cleaner is a concentrated composition which is preferably diluted prior to distribution to consumers for end use, such as by bottlers. The cleaning composition contains the following components:

(a) at least one water-soluble organic solvent present in a solubilizing effective amount;

(b) at least one ionic surfactant which may be the product of the saponification of at least one fatty acid by an amino alcohol in a water-soluble organic solvent, wherein the ionic surfactant is present in a cleaning-effective amount;

(c) at least one nonionic surfactant present in a cleaning-effective amount;

(d) a chelating agent capable of chelating multivalent metal ions, wherein the chelating agent is present in an amount effective to prevent phase reversal of the oil-in-water emulsifier; and (e) the remainder, distilled water.

Additional adjuncts in small amounts such as fragrance, dye and the like can be included to provide desirable attributes of such adjuncts.

In the application, effective amounts are generally those amounts listed as levels of ingredients in the descriptions which follow hereto. Unless otherwise stated, amounts listed in percentages are in weight percents (%'s) of the composition.

Solvent

The solvent should be a water-soluble organic solvent. Further, the solvent is preferably a water-soluble organic ether. The most preferred water-soluble organic solvent is tetrahydrofurfuryl alcohol (THF-A). THF-A is an organic solvent that is completely miscible with water. THF-A has an extensive history of use as a highly versatile, high purity solvent. Due to its relatively benign nature and the fact that it is not oil-based, THF-A is generally regarded as a "green" solvent in industrial applications. THF-A readily biodegrades in soil, sludge, and water. The atmospheric half life is 13 hours. Unused THF-A is not classified as a hazardous waste under the Resource Conservation and Recovery Act.

Surfactants

The at least one ionic surfactant is the product of the saponification of at least one fatty acid by an amino alcohol in a water-soluble organic solvent. The preferred at least one fatty acid is chosen from the group comprising saturated fatty acids of the general formula $C_xH_{2x}O_2$, wherein the value of x is preferably any whole number between and including 16 and 24; monounsaturated or polyunsaturated fatty acids of the general formula $C_xH_{(2x-y)}O_2$, wherein the value of x is preferably any whole number between and including 16 and 20 and the value of y is preferably either 2 or 4; and mixtures thereof. A more preferred fatty acid is one chosen from the group comprising palmitic acid; palmitoleic acid; stearic acid; oleic acid; linoleic acid; 5,9,12-octadecatrienoic acid; 5,11,14-eicosatrienoic acid; cis,cis-5,9-octadecadienoic acid; cis-11-octadecanoic; eicosanoic acid; docosanoic acid; tetracosanoic acid; and mixtures thereof. The most preferred fatty acid is tall oil also known as pine oil. Tall oil is commercially available as MeadWestvaco L-5, marketed by MeadWestvaco, which comprises at least 95% tall oil fatty acid and less than 5% rosin acids. Any suitable fatty acid may contain rosin acids present in small amounts not to exceed about 5% by weight of the total weight of the fatty acid. The preferred amino alcohol is an ethanolamine. The most preferred amino alcohol is monoethanolamine.

The preferred at least one ionic surfactant is at least one fatty acid amide. The preferred at least one fatty acid amide is a member of the group of amides comprising compounds with the structure $CH_3(CH_2)_xCONH(CH_2)_2OH$, wherein the value of x is preferably any whole number between and including 14 and 22;

$CH_3(CH_2)_xCH{=}CH(CH_2)_yCONH(CH_2)_2OH$, wherein the value of x+y is preferably any whole number between and including 12 and 16;

$CH_3(CH_2)_xCH{=}CH(CH_2)_yCH{=}CH(CH_2)_zCONH(CH_2)_2OH$, wherein the value of x+y is preferably any whole number between and including 10 and 14; and mixtures thereof.

The at least one nonionic surfactant is a polyethylene oxide condensate of an alkyl phenol. Suitable nonionic surfactants are octylphenol ethoxylates that have the chemical formula $C_8H_{17}(C_6H_4)O(CH_2CH_2O)_xH$, wherein the average value of x for any mixture of these compounds is preferably any number between and including 3 and 11. Optimally two nonionic surfactant mixtures are used, wherein the average value of x for the first nonionic surfactant mixture is preferably 4.5, and wherein the average value of x for the second nonionic surfactant mixture is preferably 9.5. These preferred nonionic surfactant mixtures are commercially marketed under the names Triton X-45 and Triton X-100 by The Dow Chemical Company.

Chelating Agent

The chelating agent is required to chelate multivalent metal ions and thus prevent phase reversal of the oil-in-water emulsifier. The preferred chelating agent is an aminocarboxylic acid salt. The most preferred chelating agent is tetrasodium ethylenediaminetetraacetic acid ($Na_4EDTA$). This compound is commercially marketed as an aqueous solution of about 38% by weight $Na_4EDTA$ under the name Versene by The Dow Chemical Company.

Water and Miscellaneous

The invention comprises a cleaning concentrate. Water may be present at levels of between about 6% and about 99.6% by volume. The most preferred amount of water is between about 47% and about 53% by volume. The preferred embodiment of this invention is a concentrated formulation which is preferably further diluted with water before end use. Some of the amides and acids that are present in this composition are known to undergo intermolecular and intramolecular Diels-Alder cyclization reactions. Some of the products of those reactions are known to have biological activity. Because these products are present in the cleaning composition of the current invention, and these products show biological activity, no additional biocide is necessary in this composition. By way of example, but not limitation one of these cyclization products is cyclopinolenic acid. Additionally, small amounts of adjuncts may be added to the composition for aesthetic qualities. These adjuncts include perfumes and dyes.

The invention further provides a method for formulating the cleaning concentrate. The method of formulating the cleaning composition of the present invention relies upon adherence to certain process parameters that lead to a unique product. The order of addition of the various components is critical. It is also vital that the process temperature be maintained throughout the procedure.

The composition is formulated in a reactor. The preferred reactor is a glass or Hastelloy reactor equipped with a reflux condenser and a means of stirring. The means of stirring may be a stir bar or agitator. The reactor should be clean prior to the reaction.

The reactor is charged with a water-soluble organic solvent. A suitable amount of water-soluble organic solvent is between about 3% and about 16% by weight of the total composition. The most preferred amount of water-soluble organic solvent is between about 3% and about 9% by weight of the total composition. In a preferred embodiment the water-soluble organic solvent is a water-soluble organic ether. In the most preferred embodiment the water-soluble organic solvent is tetrahydrofurfuryl alcohol (THF-A).

The reactor is charged with an amino alcohol. The stirring mechanism is employed while the reactor is charged with the amino alcohol. The stirring mechanism is continuously employed during the remainder of the process. A suitable amount of amino alcohol is between about 3% and about 9% by weight of the total composition. The amino alcohol undergoes a chemical reaction with the fatty acid in a 1 to 1 mole ratio. However, in the preferred embodiment the fatty acid is present in excess amounts. In a preferred embodiment the amino alcohol is an ethanolamine. In the most preferred embodiment the amino alcohol is monoethanolamine.

The contents of the reactor must be heated. The preferred temperature range for this process is between 75 and 90 degrees Celsius (C.). The most preferred temperature range for this process is between 80 And 85 degrees C. This temperature range is maintained throughout the process. Immediately following additions of various components the batch temperature may fall below this range. At no time should the temperature be allowed to fall below 55 degrees C. The batch temperature should recover quickly to the required range.

At least one fatty acid is added to the reactor. A suitable amount of the at least one fatty acid is between about 7% and about 14% by weight of the total composition. The fatty acid is added via a clean gravity feed vessel. Alternatively a pump type vessel may be employed for the addition. After addition of the fatty acid the contents of the reactor are stirred for a first time period during which the reaction is monitored until it is complete. The reaction may be determined to be complete by any convenient method used in the art. Suitable methods include thin layer chromatography and high performance liquid chromatography.

After the reaction is determined to be complete, a first portion of distilled water is added rapidly. A suitable amount of the first portion of distilled water is between about 1% and about 9% by weight of the total composition. The mixture is stirred for a second time period which is sufficient to allow the composition to form a homogeneous mixture. Preferably the mixture is stirred for at least 10 minutes. The stirring time may increase dramatically corresponding with a scale-up of the process.

The at least one nonionic surfactant is rapidly added to the reactor. A suitable amount of each nonionic surfactant is between about 7% and about 30% by weight of the total composition. The most preferred amount of each nonionic surfactant is between about 8% and about 30% by weight of the total composition. The mixture is stirred for a time period which is sufficient to allow the composition to form a homogeneous mixture. Preferably the mixture is stirred for at least 10 minutes. The stirring time may increase dramatically corresponding with a scale-up of the process.

The chelating agent is added to the reactor. The preferred amount of chelating agent is between about 2% and about 8% by weight of the total composition. The chelating agent may be added to the present composition as an aqueous solution. In a preferred embodiment the chelating agent is added to the composition as an aqueous solution, and the chelating agent is present at a concentration of between about 36% and about 40% by weight in the aqueous solution. A commercially available aqueous solution of a chelating agent, such as Versene, may be used. A suitable amount of the aqueous solution of chelating agent is between about 7% and about 19% by weight of the total composition. The most preferred amount of the aqueous solution of chelating agent is between about 8% and about 19% by weight of the total composition.

Distilled water is added to the reactor. The distilled water makes up the balance of the composition. A preferred amount of distilled water for the second addition of distilled water is between about 4% and about 44% by weight of the total composition. The composition is allowed to cool to within 25 to 30 degrees C.

Optionally, after cooling and prior to commercial distribution, the composition may be passed through a filter to remove any debris acquired during the processing steps.

Certain modifications and improvements will occur to those skilled in the art upon a reading of the foregoing description. By way of example, applications for this cleaning composition may be extended to a cleaner for aircrafts which have exterior coatings similar or identical to automobiles. All modifications and improvements have been deleted herein for the sake of conciseness and readability but are properly within the scope of the following claims.

DESIGN EXAMPLE

This section outlines a design example, not necessarily optimized but illustrative of a suitable method, wherein the cleaning composition of the current invention may be formulated.

Example

In this preferred embodiment of the method of formulating a cleaning composition in a concentrated form a reactor is charged with tetrahydrofurfuryl alcohol. The reactor is then charged with monoethanolamine, wherein the volume of monoethanolamine is one half the volume of the tetrahydrofurfuryl alcohol. The contents of the reactor are heated to within the range of 80 to 90 degrees C. The reactor is charged with tall oil (MeadWestvaco L-5) acquired from MeadWestvaco. The volume of tall oil is equal to the volume of the tetrahydrofurfuryl alcohol. The contents of the reaction are stirred until the reaction is determined to be complete. The reaction progress is followed by thin layer chromatography. The reactor is charged with a first portion of distilled water, wherein the volume of the first portion of distilled water is equal to the volume of the tetrahydrofurfuryl alcohol. The contents of the reaction are stirred for ten minutes. The reactor is charged with the nonionic surfactants Triton X-100 and Triton X-45, acquired from the Dow Chemical Company, wherein the amount of each nonionic surfactant is equal to the volume of the tetrahydrofurfuryl alcohol. The contents of the reactor are stirred for ten minutes. The reactor is charged with the commercially available aqueous solution of tetrasodium ethylenediaminetetraacetic acid Versene, wherein the amount of Versene is equal to the volume of the tetrahydrofurfuryl alcohol. The reactor is charged with a second portion of distilled water, wherein the volume of the second portion of distilled water is equal to five times the volume of the tetrahydrofurfuryl alcohol, and the mixture is allowed to cool to about room temperature.

What is claimed is:

1. A cleaning composition in a concentrated form comprising:

(a) a water-soluble organic solvent, wherein the water soluble organic solvent is tetrahydrofurfuryl alcohol, (b) at least one surfactant, wherein the at least one surfactant is the product of saponification of at least one fatty acid by an amino alcohol, (c) at least one additional nonionic surfactant, (d) a chelating agent, and (e) the remainder distilled water.

2. The cleaning composition according to claim 1, wherein the amount of water-soluble organic solvent is between about 3% and about 16% by weight of the total composition.

3. The cleaning composition according to claim 1, wherein the amount of water-soluble organic solvent is between about 3% and about 9% by weight of the total composition.

4. The cleaning composition according to claim 1, wherein the amino alcohol is an ethanolamine.

5. The cleaning composition according to claim 1, wherein the amino alcohol is monoethanolamine.

6. The cleaning composition according to claim 1, wherein the amount of amino alcohol is between about 3% and about 9% by weight of the total composition.

7. The cleaning composition according to claim 1, wherein the amount of the at least one fatty acid is between about 7% and about 14% by weight of the total composition.

8. The cleaning composition according to claim 1, wherein the at least one fatty acid may contain rosin acids present in small amounts not to exceed about 5% by weight of the total weight of the at least one fatty acid.

9. The cleaning composition according to claim 1, wherein the at least one fatty acid is chosen from the group comprising saturated fatty acids of the general formula $C_xH_{2x}O_2$, wherein the value of x is any whole number between and including 16 and 24; monounsaturated or polyunsaturated fatty acids of the general formula $C_xH_{(2x-y)}O_2$, wherein the value of x is any whole number between and including 16 and 20 and y is either 2 or 4; and mixtures thereof.

10. The cleaning composition according to claim 9, wherein the at least one fatty acid may contain rosin acids present in small amounts not to exceed about 5% by weight of the total weight of the at least one fatty acid.

11. The cleaning composition according to claim 1, wherein the at least one fatty acid is chosen from the group comprising palmitic acid; palmitoleic acid; stearic acid; oleic acid; linoleic acid; 5,9,12-octadecatrienoic acid; 5,11, 14-eicosatrienoic acid; cis,cis-5,9-octadecadienoic acid; cis-11-octadecanoic; eicosanoic acid; docosanoic acid; tetracosanoic acid; and mixtures thereof.

12. The cleaning composition according to claim 11, wherein the at least one fatty acid may contain rosin acids present in small amounts not to exceed about 5% by weight of the total weight of the at least one fatty acid.

13. The cleaning composition according to claim 1, wherein the at least one fatty acid is tall oil, also known as pine oil.

14. The cleaning composition according to claim 13, wherein the tall oil may contain rosin acids present in small amounts not to exceed about 5% by weight of the total weight of the tall oil.

15. The cleaning composition according to claim 1, wherein the at least one surfactant is at least one fatty acid amide.

16. The cleaning composition according to claim 15, wherein the at least one fatty acid amide is a member of the group of amides comprising compounds with the structure $CH_3(CH_2)_xCONH(CH_2)_2OH$, wherein the value of x is any whole number between and including 14 and 22; $CH_3(CH_2)_x CH{=}CH(CH_2)_yCONH(CH_2)_2OH$, wherein the value of x+y is any whole number between and including 12 and 16;

$CH_3(CH_2)_xCH{=}CH(CH_2)_yCH{=}CH(CH_2)_zCONH(CH_2)_2$ OH, wherein the value of x+y is any whole number between and including 10 and 14; and mixtures thereof.

17. The cleaning composition according to claim 1, wherein the amount of the at least one additional nonionic surfactant is between about 7% and about 30% by weight of the total composition.

18. The cleaning composition according to claim 1, wherein the at least one additional nonionic surfactant is a polyethylene oxide condensate of an alkylphenol.

19. The cleaning composition according to claim 1, wherein the at least one additional nonionic surfactant is an octylphenol ethoxylate that has the formula $C_8H_{17}(C_6H_4)O(CH_2CH_2O)_xH$, wherein the average value of x is any number between and including 3 and 11.

20. The cleaning composition according to claim 1, wherein the amount of the chelating agent is between about 2% and about 8% by weight of the total composition.

21. The cleaning composition according to claim 1, wherein the chelating agent is an aminocarboxylic acid salt.

22. The cleaning composition according to claim 1, wherein the chelating agent is tetrasodium ethylenediaminetetraacetic acid.

23. The cleaning composition according to claim 1, wherein the amount of distilled water is between about 5% and about 53% by weight of the total composition.

24. The cleaning composition according to claim 1, further comprising products of a Diels-Alder cycloaddition of the at least one fatty acid.

25. The cleaning composition according to claim 1, further comprising cyclopinolenic acid.

26. The cleaning composition according to claim 15 further comprising products of a Diels-Alder cycloaddition of the at least one fatty acid amide.

27. A cleaning composition in a concentrated form comprising:

(a) a water-soluble organic solvent, wherein the water-soluble organic solvent is tetrahydrofurfuryl alcohol;

(b) at least one surfactant, wherein the at least one surfactant is the product of the saponification of at least one fatty acid by an amino alcohol;

(c) at least one additional nonionic surfactant, wherein the at least one additional nonionic surfactant is a polyethylene oxide condensate of an alkylphenol;

(d) a chelating agent, wherein the chelating agent is an aminocarboxylic acid salt; and (e) the remainder distilled water.

28. The cleaning composition according to claim 27, wherein the amount of water-soluble organic solvent is between about 3% and about 16% by weight of the total composition.

29. The cleaning composition according to claim 27, wherein the amount of water-soluble organic solvent is between about 3% and about 9% by weight of the total composition.

30. The cleaning composition according to claim 27, wherein the amino alcohol is an ethanolamine.

31. The cleaning composition according to claim 27, wherein the amino alcohol is monoethanolamine.

32. The cleaning composition according to claim 27, wherein the amount of amino alcohol is between about 3% and about 9% by weight of the total composition.

33. The cleaning composition according to claim 27, wherein the amount of the at least one fatty acid is between about 7% and about 14% by weight of the total composition.

34. The cleaning composition according to claim 27, wherein the at least one fatty acid may contain rosin acids present in small amounts not to exceed about 5% by weight of the total weight of the at least one fatty acid.

35. The cleaning composition according to claim 27, wherein the at least one fatty acid is chosen from the group comprising saturated fatty acids of the general formula $C_xH_{2x}O_2$, wherein the value of x is any whole number between and including 16 and 24; monounsaturated or polyunsaturated fatty acids of the general formula $C_xH_{(2x-y)}O_2$, wherein the value of x is any whole number between and including 16 and 20 and y is either 2 or 4; and mixtures thereof.

36. The cleaning composition according to claim 35, wherein the at least one fatty acid may contain rosin acids present in small amounts not to exceed about 5% by weight of the total weight of the at least one fatty acid.

37. The cleaning composition according to claim 27, wherein the at least one fatty acid is chosen from the group comprising palmitic acid; palmitoleic acid; stearic acid; oleic acid; linoleic acid; 5,9,12-octadecatrienoic acid; 5,11,14-eicosatrienoic acid; cis,cis-5,9-octadecadienoic acid; cis-11-octadecanoic; eicosanoic acid; docosanoic acid; tetracosanoic acid; and mixtures thereof.

38. The cleaning composition according to claim 37, wherein the at least one fatty acid may contain rosin acids present in small amounts not to exceed about 5% by weight of the total weight of the at least one fatty acid.

39. The cleaning composition according to claim 27, wherein the at least one fatty acid is tall oil, also known as pine oil.

40. The cleaning composition according to claim 39, wherein the tall oil may contain rosin acids present in small amounts not to exceed about 5% by weight of the total weight of the tall oil.

41. The cleaning composition according to claim 27, wherein the at least one surfactant is at least one fatty acid amide.

42. The cleaning composition according to claim 41, wherein the at least one fatty acid amide is a member of the group of amides comprising compounds with the structure $CH_3(CH_2)_xCONH(CH_2)_2OH$, wherein the value of x is any whole number between and including 14 and 22; $CH_3(CH_2)_xCH{=}CH(CH_2)_yCONH(CH_2)_2OH$, wherein the value of x+y is any whole number between and including 12 and 16;

$CH_3(CH_2)_xCH{=}CH(CH_2)_yCH{=}CH(CH_2)_zCONH(CH_2)_2$ OH, wherein the value of x+y is any whole number between and including 10 and 14; and mixtures thereof.

43. The cleaning composition according to claim 27, wherein the amount of the at least one additional nonionic surfactant is between about 7% and about 30% by weight of the total composition.

44. The cleaning composition according to claim 27, wherein the at least one additional nonionic surfactant is at least one octylphenol ethoxylate that has the formula $C_8H_{17}(C_6H_4)O(CH_2CH_2O)_xH$, wherein the average value of x for any mixture of these compounds is any number between and including 3 and 11.

45. The cleaning composition according to claim 27, wherein the amount of the chelating agent is between about 2% and about 8% by weight of the total composition.

46. The cleaning composition according to claim 27, wherein the chelating agent is tetrasodium ethylenediaminetetraacetic acid.

47. The cleaning composition according to claim 27, wherein the amount of distilled water is between about 5% and about 53% by weight of the total composition.

48. The cleaning composition according to claim 27, further comprising products of a Diels-Alder cycloaddition of the at least one fatty acid.

49. The cleaning composition according to claim 41, further comprising cyclopinolenic acid.

50. The cleaning composition according to claim 41 further comprising products of a Diels-Alder cycloaddition of the at least one fatty acid amide.

* * * * *

UNITED STATES PATENT AND TRADEMARK OFFICE

CERTIFICATE OF CORRECTION

PATENT NO. : 7,008,917 B2
DATED : March 7, 2006
INVENTOR(S) : Heise et al.

It is certified that error appears in the above-identified patent and that said Letters Patent is hereby corrected as shown below:

Column 1,
Line 11, the correct serial number is -- 10/868,464 --.

Signed and Sealed this

Thirteenth Day of June, 2006

JON W. DUDAS
*Director of the United States Patent and Trademark Office*

UNITED STATES PATENT AND TRADEMARK OFFICE

CERTIFICATE OF CORRECTION

PATENT NO. : 7,008,917 B2
APPLICATION NO. : 10/868541
DATED : March 7, 2006
INVENTOR(S) : Heise et al.

It is certified that error appears in the above-identified patent and that said Letters Patent is hereby corrected as shown below:

Column 1, Line 11, the correct serial number is 10/868,464

Signed and Sealed this

Eleventh Day of July, 2006

JON W. DUDAS
*Director of the United States Patent and Trademark Office*